United States Patent [19]

Power et al.

[11] 4,153,030

[45] May 8, 1979

[54] IGNITION DISTRIBUTOR WITH WIDE ROTOR REGISTRATION ANGLE

[75] Inventors: James H. Power, Ypsilanti; Ahmet R. Akman, Farmington Hills, both of Mich.

[73] Assignee: Ford Motor Company, Dearborn, Mich.

[21] Appl. No.: 803,197

[22] Filed: Jun. 3, 1977

[51] Int. Cl.[2] ..... F02P 7/02

[52] U.S. Cl. ..... 123/146.5 A; 200/19 DC; 200/19 DR

[58] Field of Search ..... 123/148 DS, 148 C, 146.5 A, 123/32 MS; 200/19 R, 19 DC, 19 DR, 20, 21, 23, 24, 26, 28, 29

[56] References Cited

U.S. PATENT DOCUMENTS

| | | | |
|---|---|---|---|
| 2,243,269 | 5/1941 | von Tavel | 200/21 |
| 3,646,922 | 3/1972 | Spalding | 123/117 A |

*Primary Examiner*—Charles J. Myhre

*Assistant Examiner*—Tony M. Argenbright

*Attorney, Agent, or Firm*—Paul K. Godwin, Jr.; Keith L. Zerschling

[57] ABSTRACT

A distributor for use in the electrical system of an internal combustion engine, providing an increased angle of registration between a rotor element and each spark plug contact within the distributor. The rotor element is provided with a plurality of conductive rotor arms which, upon rotation, alternately register with spark plug contacts circumferentially disposed about the rotor element, wherein each spark plug contact is associated with one of the plurality of rotor arms. In one embodiment, each rotor arm includes a plurality of blades which are disposed to rotate into simultaneous registration with a single high voltage supply contact and a spark plug contact. In a second embodiment, each rotor arm includes a plurality of blades disposed to rotate into simultaneous registration with sequentially disposed ones of a plurality of high voltage supply contacts and a spark plug contact.

8 Claims, 10 Drawing Figures

IGNITION DISTRIBUTOR WITH WIDE ROTOR REGISTRATION ANGLE

BACKGROUND OF THE INVENTION

1. Field of the Invention

The present invention relates to any high voltage commutation system such as employed in an internal combustion engine.

2. Description of the Prior Art

Typically, in the prior art, distributors for use with internal combustion engines have been generally configured so as to have a centrally located coil terminal maintaining constant pressure contact with a rotor element. The rotor element was generally an elongated conductive member mounted for rotation about a central axis, defined by the axis of a rotatable shaft to which the rotor element was mounted. The shaft communicated with the crankshaft of the engine so as to receive drive rotation therefrom. The central coil terminal was disposed above the rotor on the distributor cap and, upon assembly of the cap with the remainder of the distributor, the coil terminal was in constant pressure contact with the rotor at approximately the axis of rotation of the rotor. The other end of the elongated rotor element followed a circular path about the central axis and made sequential arc-gap conduction paths with spark plug terminal contacts disposed in a single plane configuration about the circular path of the rotor.

During the development of automatic electronic ignition systems, for controlling the precise timing of the high voltage discharge to each spark plug of an internal combustion engine, it was discovered that conventional distributors were not adequate to achieve the required degree of control for optimum operational efficiency.

Due to the relatively narrow angle of registration between a rotor contact and a spark plug contact in a conventional distributor, a problem to overcome was that of arc-over between the rotor and adjacent spark plug contacts when high voltages of approximately 35,000 volts, or more, were applied to the rotor. In the conventional rotor, where the spark plug contacts were circumferentially arranged to be sequentially registered for arc-gap conduction in a single plane by the rotor, there was a tendency for arc-over between the rotor blade and either of the two adjacent terminals if spacing therebetween was not sufficiently large.

One possible solution of the problem, was to separately mechanically advance or retard the point of registration in order to achieve a desired degree of operational efficiency. Of course, such mechanical adjustment would necessitate the inclusion of conventional centrifugal and vacuum advance mechanisms or other actuation mechanisms responsive to control outputs on the automatic electronic ignition system, to effect the mechanical advancement and retardation of the above-mentioned registration point.

A condition which restricted the solving of the problem was based upon a size parameter. The conventional distributor, as presently in production, is of a certain diameter which is taken into consideration in the placement of other elements on the engine. Therefore, it was desirable to solve the problem within the space devoted to a conventional distributor, for obvious economical reasons.

SUMMARY OF THE INVENTION

The present invention overcome the aforementioned problem which appeared in prior art distributors when used with relatively high voltages of approximately 35,000 volts, or more. The distributor of the present invention, although configured to occupy the same space as a conventional distributor, has the advantage of achieving a larger angle of registration between the rotor and the spark plug terminals than was heretofore possible, while at the same time eliminating arc-over problems. The present invention is designed to operate with an ignition timing system which automatically receives timing pulses and advances or retards the discharge of a high voltage supply for application to the spark plug terminals during rotor registration, although its function as a commutator is independent of the mechanism by which it receives the high voltage charge.

In addition, the present invention has the advantage of eliminating the centrifugal and vacuum advance mechanisms which are common to the prior art.

Although the present invention is intended to be operable in conjunction with an automatic electronic timing ignition system, the disclosure of the details of such an automatic system is not necessary for a proper understanding of this invention. It is sufficient to say that the electronic timing ignition system functions, upon the reception of a train of engine speed timing pulses, to advance or retard the timing of the high voltage discharge to the spark plug terminals at a time during distributor rotor registration in accordance with the optimum operational efficiency as determined by the electronic timing ignition system. For a more detailed explanation of such an automatic system, the reader is referred to commonly assigned U.S. Pat. No. 3,969,614.

The improved distributor of the present invention is designed to operate without mechanical adjustment to accommodate wide variations in timing as determined by an electronic timing ignition system.

Therefore, it is an object of the present invention to provide a distributor which accommodates variations in advancement or retardation of the high voltage discharge to the spark plug without physical adjustment of distributor elements with respect to the speed and phase of engine rotation.

It is another object of the present invention to provide a distributor wherein wide separation is maintained between sequentially registered spark plug terminals to prohibit arc-over therebetween.

It is a further object of the present invention to provide a distributor having a rotor which is gapped with respect to both the coil terminals and the spark plug terminals to provide selective non-friction electrical communication between said coil terminal and the individual spark plug terminals.

DETAILED DESCRIPTION OF THE PREFERRED EMBODIMENTS

Figure 1:
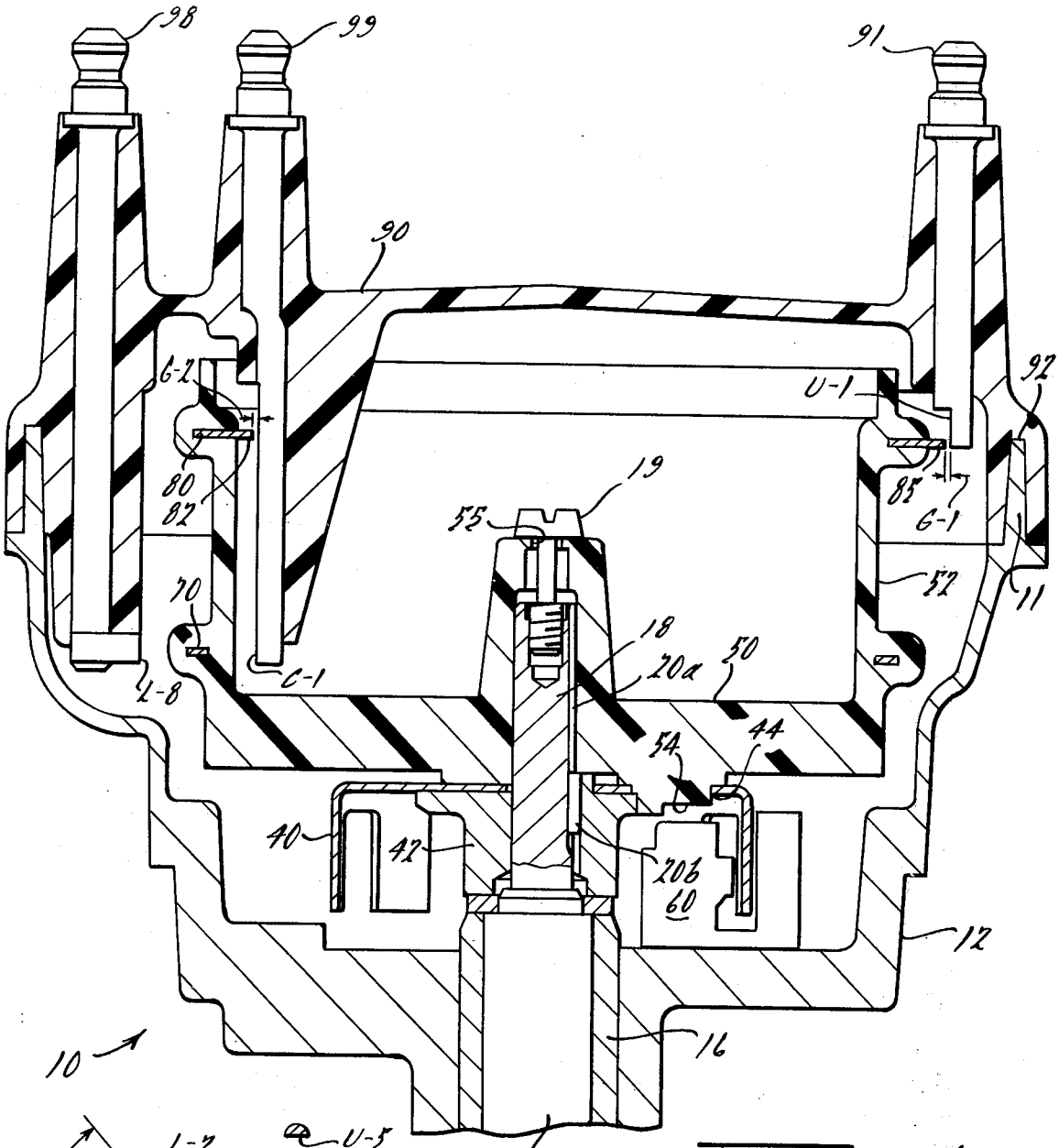
FIG. 1 is a cross-sectional view of a first embodiment of the distributor of the present invention.

A first embodiment of the present invention, as set forth in the following recitation, is described with concurrent reference to FIGS. 1, 2A, 2B and 3.

The distributor 10 is shown in cross-section as including a lower distributor housing 12, which is fixedly mounted with respect to the engine (not shown). A driven rotor shaft 14 extends through a bushing 16 into the lower distributor housing 12. One end of the driven rotor shaft 14 is preferably connected to the cam shaft of the engine for rotation thereby. A threaded mounting post 18 is attached to the other end of the driven rotor shaft 14 within the distributor 10. A collar 42, a timing element 40, and a rotor 50 are mounted on the post 18 and held in place by a screw 19 threaded into the internal threads of the mounting post 18. Key elements 20*a* and 20*b* extend outwardly from the mounting post 18 for respective engagement with key slots on the rotor 50 and the collar 42. The rotor 50 and the collar 42 have key slots which respectively accept the keys 20*a* and 20*b* so as to provide fixed orientation with respect to the post 18, when the elements are assembled.

The timing element 40 is, preferably, a cup-shaped ferromagnetic structure having a number of teeth which extend toward and pass through a space provided in a timing sensor 60. The number of teeth are the same or some multiple of the number of spark plugs (cylinders) of the particular engine being supplied with high voltage by the distributor 10. The timing sensor 60 may be any conventional sensor which detects the presence or absence of the teeth of the ferromagnetic timing element 40 in a predetermined location and converts that detection into an electrical pulse signal used for timing. Such a sensor is shown in commonly assigned U.S. Pat. No. 4,011,476. The timing sensor 60 may, in the alternative, be an optical sensing device wherein the teeth 40 interrupt the radiation from a constant light source. Although the first embodiment of the present invention illustrates a timing element 40 and a timing sensor 60 mounted in the distributor 10, it should be understood that such disclosure is merely for the purpose of presenting a preferred mode, and is not restrictive, since many other techniques for deriving timing pulses, indicative of the engine speed, are well known in this art.

In this first embodiment, the timing element 40 has an orienting slot 44 for receiving a protrusion 54 extending from the lower part of the rotor 50. The location of the slot 44 and the protrusion 54 are predetermined so that, if desired, a maximum advanced timing signal may be generated by the timing sensor 60. In such a case, the signal output from the timing sensor 60 will then be electronically delayed by an amount of time, as determined by the automatic electronic timing ignition system.

The rotor 50 is a unitary structure molded in a cylindrical cup-shape configuration and mounted for rotation about a central axis. The material used to form the rotor 50 must necessarily be formable as a rigid structure having a high dielectric property to provide insulation between conducting rotor arms. The cylindrical sidewalls of the cup-shape rotor 50 contain the rotor arms which supply the arc-gap connection between a coil terminal and the spark plug terminals. Circularly shaped rotor arms 70 and 80, respectively designated as the lower and upper arms, are embedded (molded) in the cylindrical sidewall of the rotor 50. The rotor arms 70 and 80 are separated by a straight line distance, along the sidewall of the rotor 50, which is sufficient to prevent arc-over or condition therebetween.

The lower rotor arm 70 and the upper rotor arm 80 are quite similar in structure in that each is a circularly shaped, electrically conductive element having a single, outwardly extending, arcuate blade and a plurality of equally spaced, inwardly extending, arcuate blades.

In FIGS. 1–4, it is seen that each of the rotor arms has four inwardly extending blades to provide distribution of spark to four associated spark plugs in an eight cylinder engine. Of course, it is understood that the number and location of the inwardly extending blades will be a function of the particular type engine being controlled.

A distributor cap 90 is mounted on the lower distributor housing 12. A circular projection 11 extending upwardly from the lower distributor housing 12 mates with a circular slot 92 in the distributor cap 90. Utilizing, for example, a springtype retainer (not shown) the distributor cap 90 is secured in place on the lower distributor housing 12 to provide a dust-free environment.

The distributor cap 90 is a unitary structure having a plurality of electrical terminals molded therein. The distributor cap 90 is formed of a rigid material having a high dielectric property to provide electrical insulation between the terminals.

Figure 3:
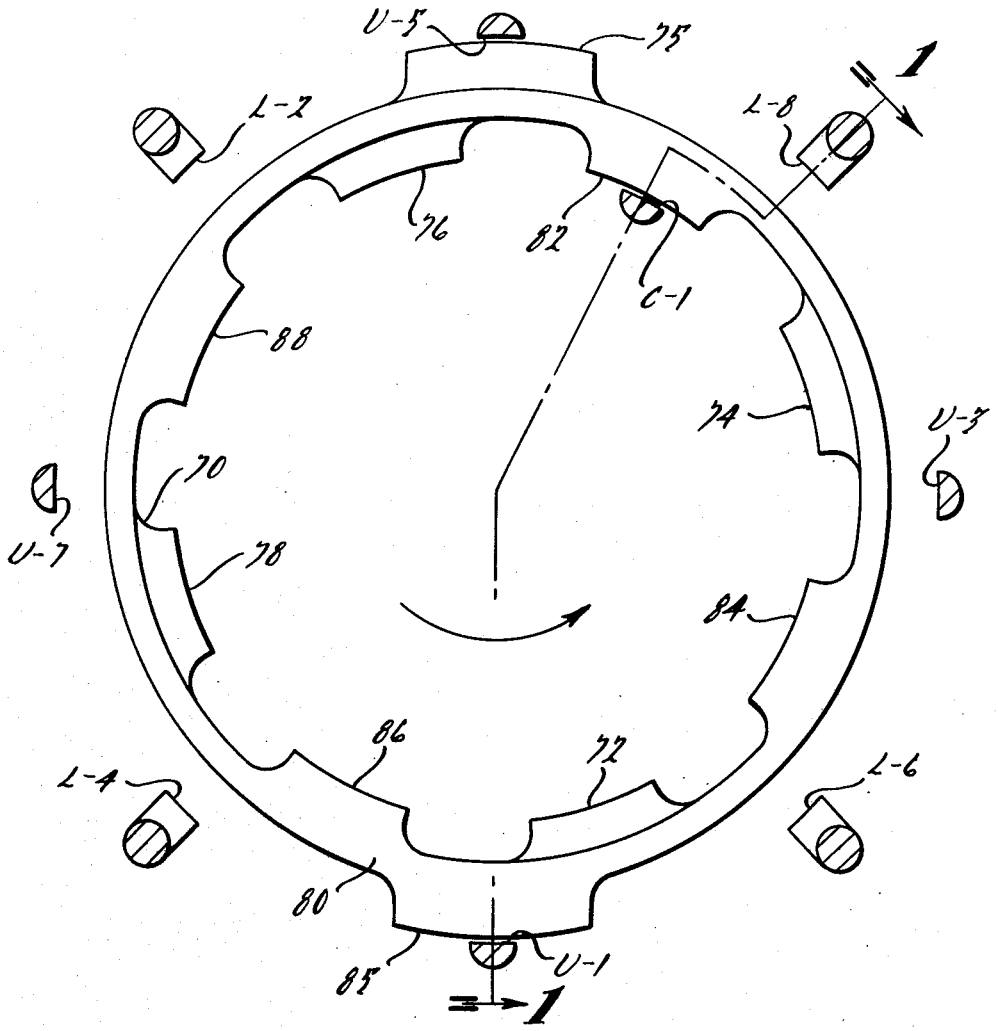
FIG. 3 is a composite top view showing the upper and lower rotor arms superimposed for rotation within the first embodiment of the distributor.
Figure 2A:
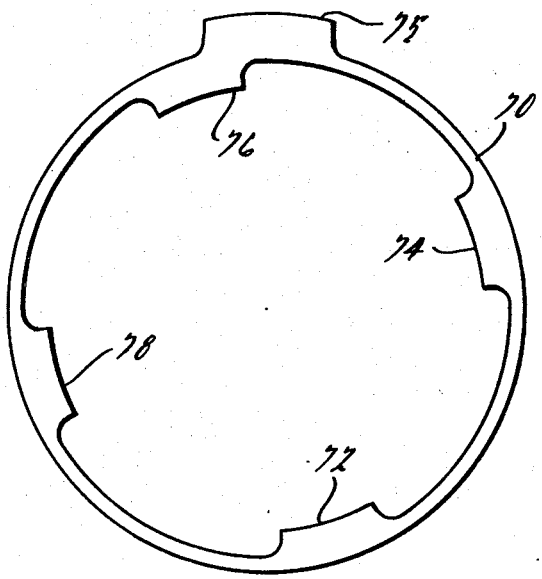
FIG. 2A is a top plan view of the lower rotor arm of the first embodiment.
Figure 2B:
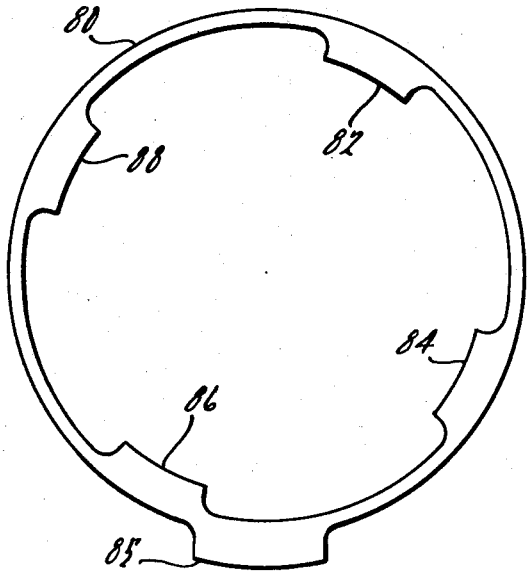
FIG. 2B is a top plan view of the upper rotor arm of the first embodiment.

The depiction of the distributor 10, shown in FIG. 1, is a cross-section taken along the broken line 1—1 shown in FIG. 3. Therefore, only coil terminal 99 and spark plug terminals 91 and 98 are shown in FIG. 1. However, in this first embodiment, eight spark plugs are controlled and therefore it should be understood that eight evenly spaced spark plug terminals are provided in the distributor cap 90.

The spark plug terminal 91 is connected to an upper contact U-1 and the spark plug terminal 98 is connected to a lower contact L-8. The remaining six spark plug terminals of the distributor are respectively connected to upper contacts U-3, U-5 and U-7, and lower contacts L-2, L-4 and L-6. The numbering of the contacts in this embodiment signifies a firing order during operation of the distributor, explained in further detail below.

The terminal 99 receives the high voltage from a high voltage supply for distribution to the various spark plug terminals and associated spark plugs of the engine. For convenience, but not restrictive to any particular type of ignition control system supplying the high voltage, terminal 99 is referred to as "coil terminal". The coil terminal 99 is connected to the coil contact C-1, which extends in the distributor 90 so as to be separately registered for arc-gap conductance by the inwardly extending blades of both the lower rotor arm 70 and the upper rotor arm 80 as the rotor 50 is driven.

In the static representation of the distributor 10 depicted in FIG. 1 and 3 an electrically conductive path is provided between the coil terminal 99 and the spark plug terminal 91. The path is defined as extending from the coil terminal 99, through the contact C-1, across an acr-gap G-2, through the inwardly extending blade 82 of the upper rotor arm 80, through the outwardly extending blade 85 of the upper rotor arm 80, across a second arc-gap G-1 and through the upper contact U-1 to the spark plug terminal 91.

Figure 4:
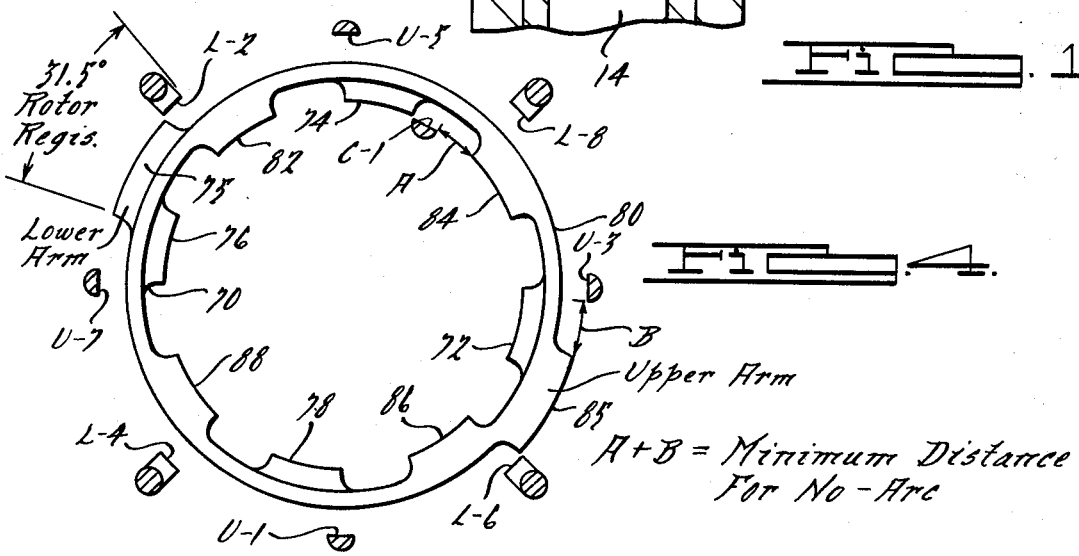
FIG. 4 is a composite top view, as in FIG. 3, showing the maximum angle of registration achieved within the minimum "NO-ARC" measurement constriction.

In operation, the rotor 50 rotates in a counterclockwise direction and alternately provides conductive paths through the upper rotor arm 80 and the lower rotor arm 70. With reference to FIGS. 3 and 4, when the rotor rotates, the contact C-1 will next be in electrical contact across the arc-gap G-2 with the inwardly extending blade 74 of the lower rotor arm 70. The complete electrical path is then formed from the outwardly extending blade 75 of the lower rotor arm 70 across the arc-gap G-1, to the lower contact L-2 and its associated spark plug terminal extending above the distributor cap 90.

Of course, the major advantage of having upper and lower rotor arms provides for a wider angle of registration between the blades of each rotor arm and the associated contacts. That advantage is illustrated in FIG. 4 within the parameters which must be considered in order to achieve a wide angle of registration between the spark plug contacts and the rotor. In the first embodiment, it was found that a distance of at least 0.80 inches (2.03 cm) must be maintained between the adjacent exposed elements to prevent undesired arc-over for the particular value of high voltage employed. Therefore, since the contact elements were selected as being of equal width, it was decided that the inwardly extending blades and outwardly extending blades should be selected to extend over the same arc-angle value to achieve co-registration of the two types of blades with their respectively associated contacts as the rotor is rotated.

As can be seen in FIG. 4, the arc-angle plus the width of a contact defines the limits of the rotor registration angle. The minimum distance for "NO-ARC" (0.80 inches (2.03 cm)) is shown in FIG. 4 as divided into distances A+B. To illustrate these distances, the lower rotor arm 70 is shown in FIG. 4 with the outwardly extending rotor blade 75 at a maximum end of its registration with the lower contact L-2 and the inwardly extending blade 74 registered with coil contact C-1. The distance A, at that point of rotation, is provided to prevent arc-over between the contact C-1 and the adjacent inwardly extending blade 84 of the upper rotor arm 80, along with the distance B between the outwardly extending blade 85 on the upper rotor arm 80 and the upper contact U-3. If the blade elements were formed to exceed the arcuate limitations defined by the parameters for preventing arc-over, where A plus B is less than 0.8 inches, arc-over may occur between the contact C-1 and the blade 84 and between blade 85 and the contact U-3, causing high voltage to be applied to the spark plug connected to the contact U-3 as well as the spark plug connected to the registered contact L-2. For this first embodiment of the present invention, where the four upper and four lower spark plug contacts lie in vertically displaced circles, which have diameters of approximately 3.90 inches (9.91 cm), and the upper and lower rotor arms have a mean diameter of approximately 3.10 inches (7.87 cm), a maximum rotor registration angle of 31.5° was achieved. This large angle of rotor registration was found to be suitable for a wide variation in the timing of the engine while providing the necessary safeguards against arc-over between adjacent exposed elements. Of course, where space permits, the distributor may be enlarged in diameter to have a wider angle of registration, using a configuration similar to that described above.

A second embodiment 100 of the distributor of the present invention is shown in FIGS. 5A, 5B, 6A, 6B and 7. In this second embodiment, the number of spark plug contacts are separated into two sets (upper and lower), as in the first embodiment. However, in this second embodiment, a coil conductive element 124, fixedly connected at 188 to the coil terminal 199, has a plurality of contact areas C-2, C-3, C-4 and C-5. Each of the contact areas serve to separately provide electrical communication with rotor coil contacts.

In FIGS. 5A, 5B, 6A and 6B, a rotor 50 is shown mounted on a driven rotor shaft 114 extending through a fixedly mounted lower distributor housing 112. A cap 190 is detachably mounted on the lower distributor housing 112 so that a circular projection 111 extending upwardly from the lower distributor housing 112 mates with a circular slot 113 in the cap 190.

The rotor 50 carries two separate rotor conductor arm members 170 and 180 which are insulated from each other. The rotor conductor member 170 provides conduction between the coil conductive element 124, across two small air-gaps to the lower set of spark plug contacts L-102, L-104, L-106 and L-108 during individual conductive registration therewith. The rotor conductor member 180 provides electrical conduction between the coil conductive element 124, across two small air-gaps, to the upper set of spark plug contacts U-101, U-103, U-105 and U-107 during individual conductive registration therewith.

The coil conductive element 124 is fixedly secured at 188 to the coil terminal 199 on the cap 190 and configured to have a plurality of legs (four, in the case of an eight cylinder engine and three, in the case of a six cylinder engine) with coil contact areas C-2, C-3, C-4 and C-5 arcuately formed at the ends thereof.

Figures 5A, 5B:
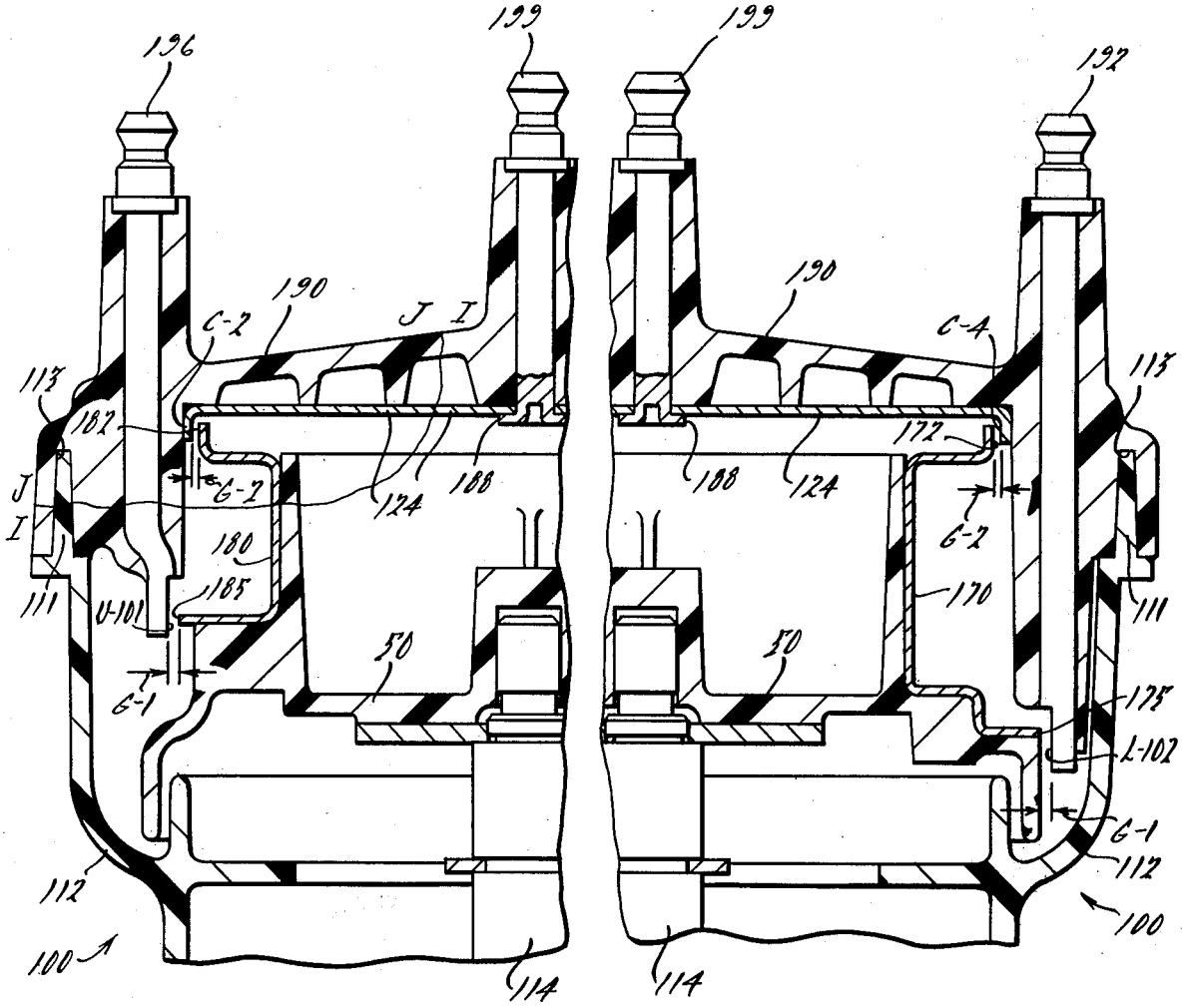
FIG. 5A is a partial cross-sectional view of a portion of a second embodiment of the invention showing rotor electrode registration with a coil contact of a multilegged coil conductive element and one of a first set of spark plug electrodes.
FIG. 5B is a partial cross-sectional plan view of another portion of the second embodiment of the invention showing a second rotor electrode registration with a coil contact of a multilegged coil conductive element and one of a second set of spark plug electrodes.
Figure 6B:
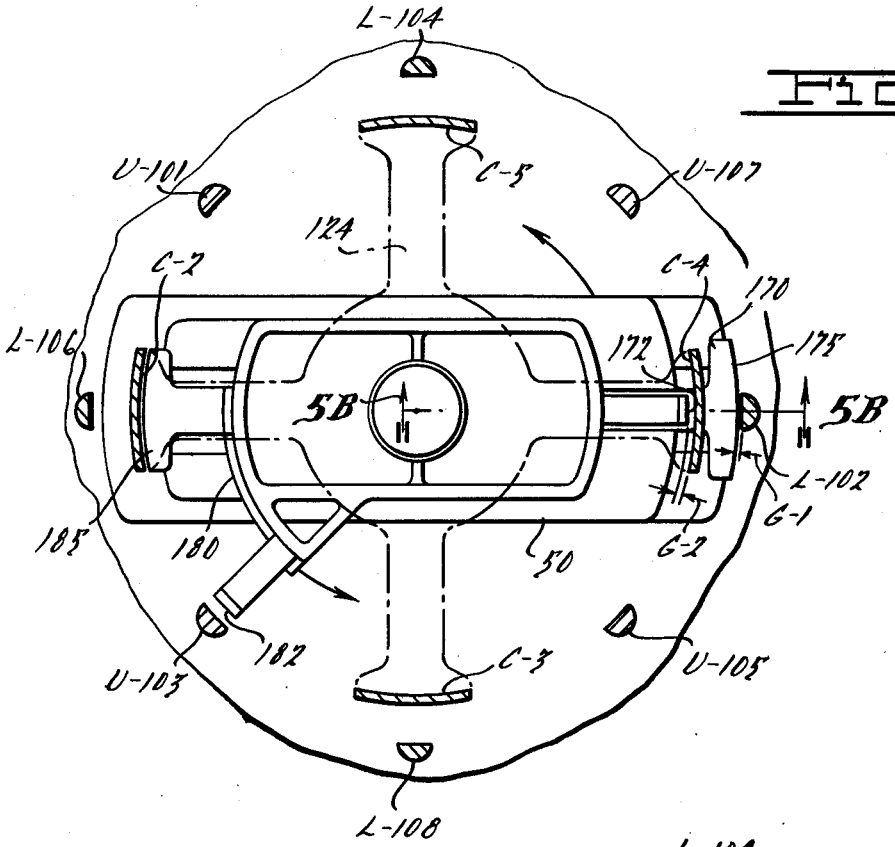
FIG. 6B is a cross-sectional top view of the second embodiment of the present invention according to FIG. 5B.
Figure 6A:
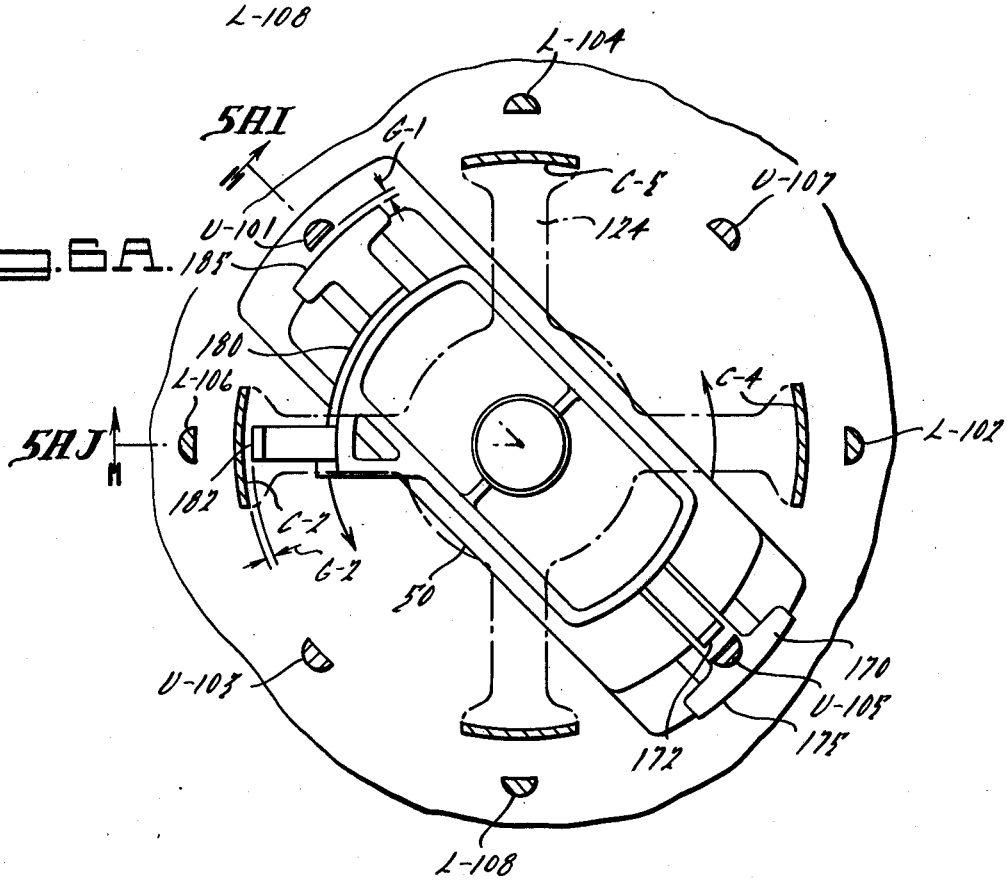
FIG. 6A is a cross-sectional top view of the second embodiment of the present invention according to FIG. 5A.

In FIGS. 5A and 6A, the rotor 50 is shown with the member 180 in conductive arc-gap registration with the coil contact C-2 and the one spark plug contact U-101, of the set of upper spark plug contacts. The rotor conductor member 180 is preferably a single piece of conductive material, such as brass, configured with an arcuate spark plug contact blade 185 angularly offset approximately 45° with respective to a coil contact blade 182. Therefore, FIG. 5A is a partial crosssection taken through two separate cutting planes 5AI and 5AJ (also indicated in FIG. 6A), to show registration of both the blade 185 and the blade 182 with the respective spark plug contact U-101 and the coil contact C-2.

Figure 7:
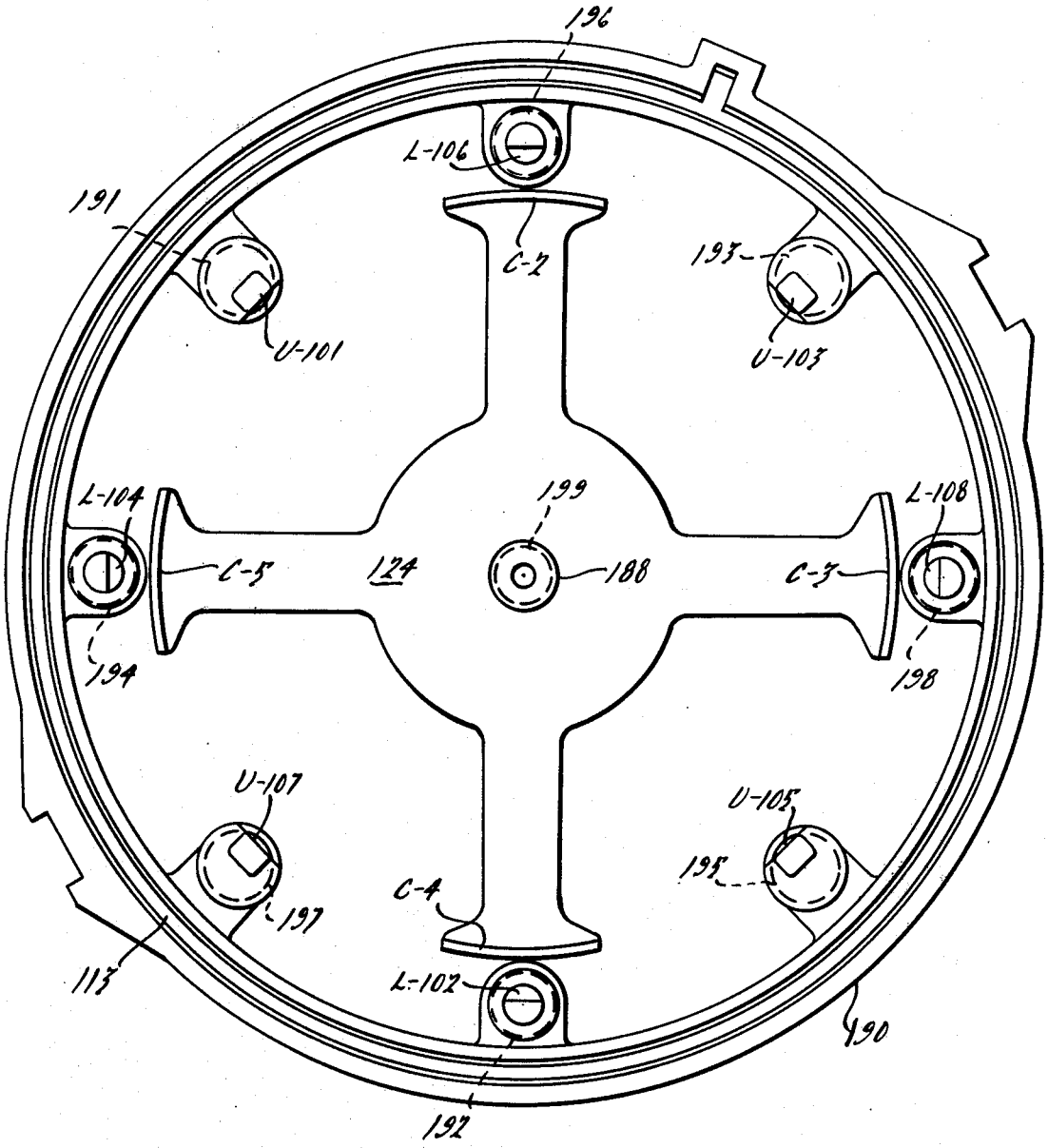
FIG. 7 is a bottom view of the distributor cap of the second embodiment shown in FIGS. 5A and 5B.

Referring to FIG. 7, which is the bottom view of the distributor cap 90, one can readily see the relationship of the spark plug terminals 191 through 198, extending from the top of the cap 90, with their corresponding spark plug contacts. The upper spark plug contacts U-101, U-103, U-105 and U-107 are disposed on a circle centered at the coil connection 188. Similarly, the lower spark plug contacts L-102, L-104, L-106 and L-108 are disposed on a slightly larger circle centered at the coil connection 188. As seen in FIG. 7, the upper spark plug contacts are disposed between adjacent coil contacts and the lower spark plug contacts are disposed adjacent respectively corresponding coil contacts. The difference in diameter between the circles, upon which the upper and lower contacts lie, provides clearance between the blade 185 and the insulation of the cap 90 surrounding the lower spark plug terminals as the rotor element 50 is rotated.

In FIGS. 5B and 6B, the rotor 50 is shown with the member 170 in conductive arc-gap registration with the coil contact C-4 and the one spark plug contact L-102 of the set of lower spark plug contacts. The rotor conductor member 170 is preferably a single piece of conductive material configured to have an arcuate spark plug contact blade 175 and a coil contact blade 172. The blade 175 and the blade 172 are oriented on the rotor 50 to obtain a simultaneous registration between the corresponding coil contacts and lower spark plug contacts.

In operation, the rotor element 50, preferably constructed to be weight balanced with the conductive elements mounted at the ends thereof, rotates counterclockwise to sequentially supply high voltage discharge potential from the coil terminal 199 to the spark plug terminals (191, 192, 193, 194, 195, 196, 197, 198, 191, . . . etc.) at specific time intervals as determined by the ignition system, as earlier described. As the spark plug contact blade 185 and its associated coil contact blade 182 respectively approach a corresponding upper spark plug contact U-101 (similarly, U-103, U-105 or U-107) and a coil contact C-2 (similarly C-1, C-3, and C-4) to a point where the air-gap distance is small enough to allow conduction therebetween of the high voltage discharge potential the rotor is registered for spark plug firing. This registration extends over an angle of rotation which is maximized in the above configuration due to the arcuate shape of the blade 185 and the arcuate shape of the coil contacts.

From the position shown in FIG. 6A to the position shown in FIG. 6B, the rotor conductor member 170 with contact blade 175 and its associated coil contact blade 172 approaches a corresponding lower spark plug contact L-102 (similarly, L-104, L-106, or L-108) and a coil contact C-4 (similarly C-1, C-2, and C-3) until conductive arc-gap registration is achieved over the predetermined registration angle.

Of course, the minimum A+B distance for "No-Arc" is achievable in this second embodiment, as it is in the first embodiment. The combined distance between the closest points of the rotor conductor member and my two adjacent spark plug contacts exceeds the minimum distance, which is 0.8 inches (2.03 cm) in this example.

It is clear, from the above description of the first and second embodiments of the present invention, that a wide angle of registration is achieved in supplying the high voltage discharge to the spark plug terminals in sequence, while at the same time eliminating any chance of arc-over between adjacent electrodes. This is also seen as being effectively accomplished by increasing the vertical separation and decreasing the diameter. This concept could, of course, be employed using a greater number of vertically stacked planes wherein fewer spark plug contacts would be associated with each rotor conducting element.

Additional changes in construction will occur to those skilled in the art and various apparently different modifications and embodiments may be made without departing from the scope of the invention. The matter set forth in the foregoing description and accompanying drawings is offered by way of illustration only. The actual scope of the invention is intended to be defined in the following claims when viewed in their proper perspective against the prior art.

What we claim is:

1. A distributor for providing sequential electrical conducting paths between a first terminal and individual ones of a plurality of second terminals and between said first terminal and individual ones of a plurality of third terminals, comprising:

a housing;

said first terminal, said second terminals and said third terminals mounted on said housing;

rotor means mounted in said housing for rotation about an axis, said rotor means including a first circularly planar electrically conductive element having a plurality of inwardly extending arcuate blades and a single outwardly extending arcuate blade for providing an electrical path between said first terminal and a selected one of said second terminals, and a second circularly planar electrically conductive element having a plurality of inwardly extending arcuate blades and a single outwardly extending arcuate blade, electrically insulated from said first element, for providing, in alternation with said first element, an electrical path between said first terminal and a selected one of said third terminals.

2. A distributor for sequentially connecting individual conductive paths to a common conductive path comprising:

means defining said common path;

means defining a first plurality of conductive paths electrically insulated from each other;

means defining a second plurality of conductive paths electrically insulated from each other;

means for mounting said common path, said first path and said second path defining means insulated from each other;

means mounted for rotation about a predetermined axis within said mounting means for alternately electrically connecting said common path defining means to said first path defining means and said common path defining means to said second path defining means;

wherein said connecting means includes a first circularly planar electrically conductive member having a plurality of inwardly extending arcuate blades for electrically contacting said common path defining means and a single outwardly extending arcuate blade for simultaneously electrically contacting said first path defining means and providing for the sequential selection of individual ones of said first paths and corresponding electrical connection therebetween as said connecting means is rotated;

said connecting means further includes a second circularly planar electrically conductive member, electrically insulated from said first member, having a plurality of inwardly extending arcuate blades for electrically contacting said common path defining means, in alternation with the contacting by said first member, and a single outwardly extending arcuate blade for simultaneously electrically contacting said second path defining means and providing for the sequential selection of individual ones of said second paths and corresponding electrical connection therebetween as said connection means is rotated.

3. A distributor as in claim 2, wherein said common path defining means is a conductive terminal having first and second contact areas respectively associated for electrical contact by said inwardly extending blades of said first and second conductive members.

4. A distributor as in claim 3, wherein said first path defining means includes a first plurality of terminals each having a first path contact area disposed for electrical contact by said outwardly extending blade of said first conducting member and insulated from electrical contact by said second conductive member.

5. A distributor as in claim 4, wherein said second path defining means includes a second plurality of terminals each having a second path contact area disposed for electrical contact by said outwardly extending blade of said second conductive member and insulated from electrical contact by said first conductive member.

6. A distributor as in claim 5, wherein said electrical contact between blades of said members and said contact areas is defined when any said blade and contact area are proximate to each other within a predetermined finite distance.

7. A distributor for sequentially applying spark potential to a plurality of spark plugs in an internal combustion engine, wherein said distributor comprises:

a distributor housing fixedly mounted on said engine;

a shaft rotatably mounted with respect to said housing and said engine to rotate synchronously with the rotational speed of said engine;

said housing having an aperture and said shaft extending through said aperture internal to said housing;

a rotor mounted on said shaft for rotation therewith;

said rotor including separate rotor arm members electrically insulated from each other;

each rotor arm member being generally circular in shape, having a single arcuate blade portion extending outwardly therefrom and having a plurality of arcuate blade portions extending radially inward therefrom;

said housing includes a plurality of terminals mounted thereon corresponding in number to the number of spark plugs in said engine and one additional terminal for receiving said spark potential to be distributed to said spark plugs;

said plurality of terminals each having a single contact area within said housing and disposed around said rotor to be individually registered for electrical conduction by an externally extending blade of one of said first and second members;

said additional terminal having separate contact areas respectively corresponding to separate rotor arms members, within said housing disposed radially inward of said inwardly extending blades of said members to be separately and sequentially registered for electrical conduction with an inwardly extending balde simultaneous with the externally extending blade registration of a corresponding rotor arm member.

8. A distributor as in claim 7, wherein said rotor includes two rotor arm members mounted for rotation in parallel planes, said plurality of terminals are defined in two groups wherein said first group has said contact areas disposed in said first plane and said second groups has said contact areas disposed in said second plane, and said additional terminal having two individual contact areas disposed respectively in said first and second planes.

* * * * *